US006483995B2

(12) United States Patent
Iwaki et al.

(10) Patent No.: US 6,483,995 B2
(45) Date of Patent: Nov. 19, 2002

(54) REPLACEABLE UNIT HAVING A FUNCTION OF IDENTIFYING A NEW/USED STATE THEREOF AND APPARATUS OPERABLE WITH THE REPLACEMENT UNIT

(75) Inventors: Shinya Iwaki, Kawasaki (JP); Tomokazu Nakashima, Kawasaki (JP); Kazuo Shimada, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/781,992

(22) Filed: Feb. 14, 2001

(65) Prior Publication Data

US 2002/0003966 A1 Jan. 10, 2002

(30) Foreign Application Priority Data

Jul. 6, 2000 (JP) ..... 2000-205283

(51) Int. Cl.[7] ..... G03G 15/00

(52) U.S. Cl. ..... 399/12; 399/13; 399/33

(58) Field of Search ..... 399/12, 13, 33, 399/122

(56) References Cited

U.S. PATENT DOCUMENTS

| | | | | |
|---|---|---|---|---|
| 4,609,279 A | | 9/1986 | Hausmann et al. | |
| 4,774,524 A | | 9/1988 | Warbus et al. | |
| 6,104,888 A | * | 8/2000 | Kobayashi | 399/12 |
| 6,262,170 B1 | * | 7/2001 | Bortnem | 399/13 |

FOREIGN PATENT DOCUMENTS

| | | |
|---|---|---|
| JP | 55-79186 | 6/1980 |
| JP | 11-153918 | 6/1999 |
| JP | 11-288191 | 10/1999 |

* cited by examiner

*Primary Examiner*—William J. Royer
(74) *Attorney, Agent, or Firm*—Armstrong, Westerman & Hattori, LLP

(57) ABSTRACT

A replaceable unit to be placed in an apparatus, is provided with a relay which includes a latching type switch and outputs a new/used identification signal which indicates whether the replaceable unit is new or used depending on open and closed states of the switch, a detecting part which detects an operating state within the replaceable unit and outputs a state detection signal indicating the operating state, and a single signal line which is used in common for transferring the new/used identification signal and the state detection signal.

8 Claims, 10 Drawing Sheets

REPLACEABLE UNIT HAVING A FUNCTION OF IDENTIFYING A NEW/USED STATE THEREOF AND APPARATUS OPERABLE WITH THE REPLACEMENT UNIT

BACKGROUND OF THE INVENTION

This application claims the benefit of a Japanese Patent Application No.2000-205283 filed Jul. 6, 2000, in the Japanese Patent Office, the disclosure of which is hereby incorporated by reference.

1. Field of the Invention

The present invention generally relates to replaceable units and apparatuses having replaceable units, and more particularly to a replaceable unit such as a fixing unit, and to an apparatus having such a replaceable unit.

An image forming apparatus such as an electrophotography type printer is provided with a replaceable unit which is periodically replaced depending on a serviceable life of the replaceable unit. A fixing unit is one example of such a replaceable unit. A replacement interval of the fixing unit is determined depending on the service time, that is, the time for which the fixing unit is used, and the fixing unit is replaced by a new fixing unit when the service time is exceeded.

2. Description of the Related Art

Conventionally, the replacement interval of the fixing unit of the image forming apparatus, such as a printer, copying machine and facsimile machine, is determined based on an operation time for which the fixing unit is driven or a number of prints made by the fixing unit. The operation time of the fixing unit or the number of prints made by the fixing unit is counted in a counter within the image forming apparatus, and is stored in a memory within the image forming apparatus. When a counted value in the counter exceeds a predetermined value, the replacement interval of the fixing unit is notified to the user by turning ON a lamp, for example. When replacing the fixing unit by a new fixing unit, the counted value stored in the memory is cleared.

On the other hand, it is necessary to judge whether the fixing unit is new or used. According to a conventional method of judging new and used fixing units, a fuse is provided on the fixing unit. This fuse is cut when starting to use the new fixing unit, so that the new and old fixing units can be distinguished from each other by detecting the state of the fuse. Such a method of judging the new and used fixing units is proposed in a Japanese Laid-Open Patent Application No.11-153918, for example.

Furthermore, another method of judging the new and used fixing units is proposed in a Japanese Laid-Open Patent Application No.11-288191, for example. According to this proposed method, a mechanical switch is provided on the fixing unit, and this mechanical switch is disconnected when the new fixing unit is driven.

However, the conventional methods of judging the new and used fixing units provide the fuse or the mechanical switch on the fixing unit, and cut or disconnect the fuse or the mechanical switch by supplying power to the fixing unit when starting to use the fixing unit. For this reason, there was a problem in that, when forwarding the fixing unit, it is impossible to confirm whether or not a function for judging the new and used fixing units correctly operates, because the fuse or the mechanical switch will be cut or disconnected when this function is tested, and the state of the fuse or the mechanical switch cannot be restored.

In addition, the replaceable unit may include a part which actually needs to be replaced and a part which may continue to be used. However, even in the case of the replaceable unit in which such parts coexist, the fuse or the mechanical switch will be cut or disconnected in the used replaceable unit. For this reason, even if the part which needs to be replaced is replaced by a new part in the used replaceable unit and this replaceable unit is placed in the image forming apparatus, this replaceable unit will be judged as being a used replaceable unit even though this replaceable unit should be regarded as being a new replaceable unit. Consequently, there was a problem in that the parts utilization efficiency of the conventional image forming apparatus and replaceable units is poor.

SUMMARY OF THE INVENTION

Accordingly, it is a general object of the present invention to provide a novel and useful replaceable unit and apparatus having a replaceable unit, in which the problems described above are eliminated.

Another and more specific object of the present invention is to provide a replaceable unit and an apparatus having such a replaceable unit, which employ a relatively simple construction to enable correct judgement of new and used replaceable units even after a function for judging the new and used replaceable units is tested, and also enable correct judgement of new and used replaceable units even when a part of a used replaceable unit is replaced by a new part to be reused as a new replaceable unit, so that the parts utilization efficiency of the apparatus and replaceable units is improved.

Still another object of the present invention is to provide a replaceable unit to be placed in an apparatus, comprising a relay, including a latching type switch, outputting a new/used identification signal which indicates whether the replaceable unit is new or used depending on open and closed states of the switch, a detecting part detecting an operating state within the replaceable unit and outputting a state detection signal indicating the operating state, and a single signal line which is used in common for transferring the new/used identification signal and the state detection signal. According to the replaceable unit of the present invention, it is possible to employ a relatively simple construction to enable correct judgement of new and used replaceable units even after a function for judging the new and used replaceable units is tested, and also enable correct judgement of new and used replaceable units even when a part of a used replaceable unit is replaced by a new part to be reused as a new replaceable unit, so that the parts utilization efficiency of the apparatus and replaceable units is improved.

In the replaceable unit, the relay may switch the switch to an open or closed state to output a new/used identification signal which indicates that the replaceable unit is used, in response to a used setting signal which sets the replaceable unit as being used. In this case, the single signal line may further be used in common for transferring the used setting signal.

In the replaceable unit, the relay may further include a coil which is coupled in series to the switch, the detecting part may be coupled in parallel to the relay, and the single signal line may be coupled to a node which connects the relay and the detecting part. The replaceable unit may further comprise terminals, coupled to the relay, receiving a bias voltage for switching the switch to an open or closed state.

A further object of the present invention is to provide an apparatus having a replaceable unit, comprising a single signal line inputting a new/used identification signal which indicates whether the replaceable unit is new or used, and a state detection signal which indicates an operating state of the within the replaceable unit, and a controller detecting whether the replaceable unit is new or used based on the new/used identification signal which is input via the single signal line, and detecting the operating state within the replaceable unit based on the state detection signal. According to the apparatus of the present invention, it is possible to employ a relatively simple construction to enable correct judgement of new and used replaceable units even after a function for judging the new and used replaceable units is tested, and also enable correct judgement of new and used replaceable units even when a part of a used replaceable unit is replaced by a new part to be reused as a new replaceable unit, so that the parts utilization efficiency of the apparatus and replaceable units is improved.

In the apparatus, the controller may output a used setting signal which sets the replaceable unit as being used, and the single signal line may be used in common for outputting the used setting signal to the replaceable unit.

Other objects and further features of the present invention will be apparent from the following detailed description when read in conjunction with the accompanying drawings.

DESCRIPTION OF THE PREFERRED EMBODIMENTS

Figure 1:
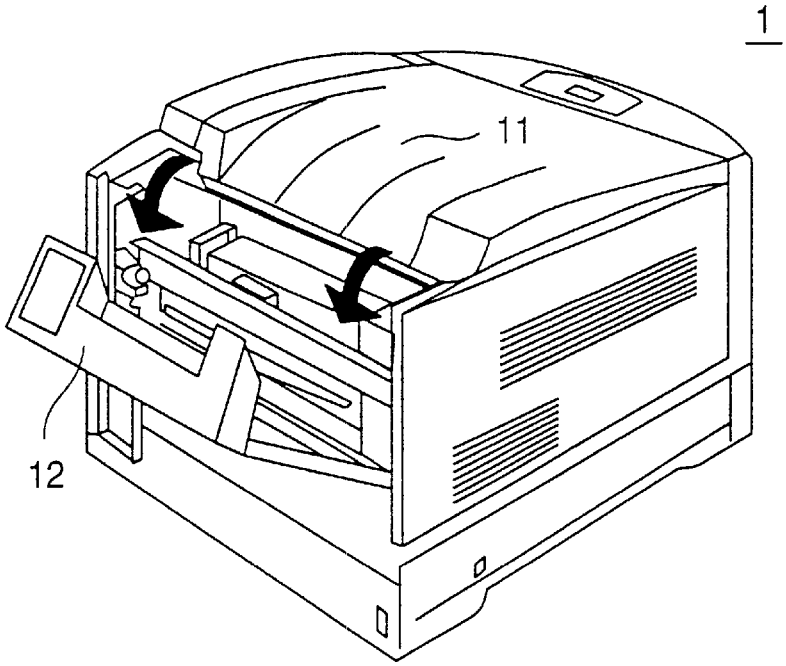
FIG. 1 is a perspective view showing a first embodiment of an apparatus according to the present invention.

A description will be given of various embodiments of a replaceable unit according to the present invention and an apparatus having a replaceable unit according to the present invention, by referring to the drawings.

First, a description will be given of a first embodiment of the apparatus having the replaceable unit according to the present invention. This first embodiment of the apparatus employs a first embodiment of the replaceable unit according to the present invention. In this first embodiment, the present invention is applied to an image forming apparatus having a replaceable fixing unit.

Figure 2:
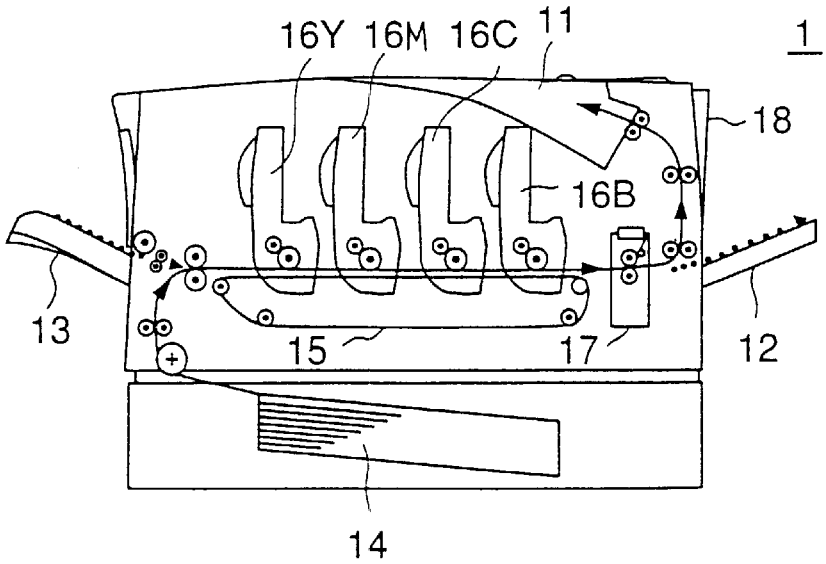
FIG. 2 is a diagram showing an internal structure of an important part of the first embodiment of the apparatus.
Figure 3:
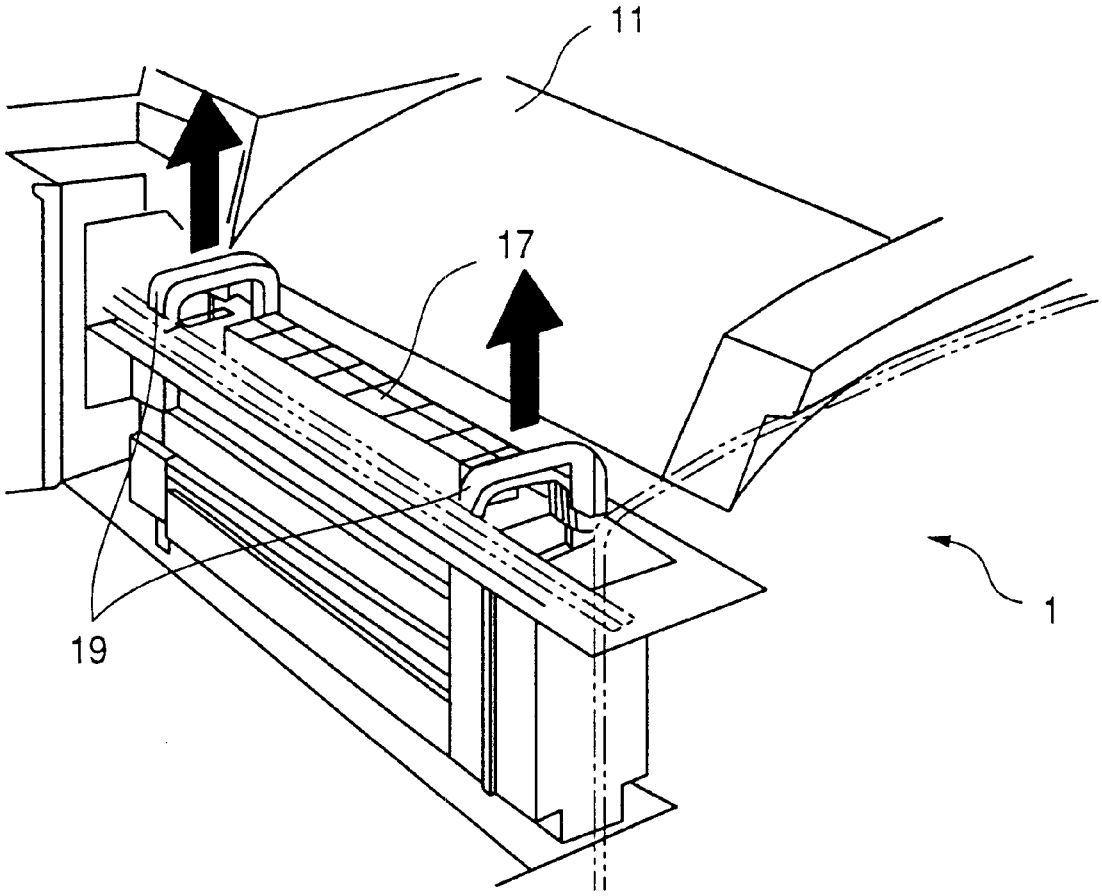
FIG. 3 is a perspective view for explaining replacement of a fixing unit.

FIG. 1 is a perspective view showing this first embodiment of the apparatus, and FIG. 2 is a diagram showing an internal structure of an important part of this first embodiment of the apparatus. Further, FIG. 3 is a perspective view for explaining replacement of the fixing unit.

The image forming apparatus shown in FIG. 1 is a color printer 1 which is provided with a face-down stacker 11, a rear stacker 12 and the like. As shown in FIG. 2, the color printer 1 is also provided with a paper supply tray 13, a paper supply cassette 14, a belt 15, printing units 16Y, 16M, 16C and 16B, a fixing unit 17, a cover 18 and the like. A recording medium such as a recording paper which is supplied from the paper supply tray 13 or the paper supply cassette 14 by a known means is transported by the belt 15, and printed with images by the printing units 16Y, 16M, 16C and 16B. More particularly, the printing units 16Y, 16M, 16C and 16B successively form a yellow toner image, a magenta toner image, a cyan toner image and a black toner image on the recording paper in an overlapping manner. The toner images on the recording paper are fixed by the fixing unit 17, and the printed recording paper is stacked on the face-down stacker 11 or the rear stacker 12 by a known means. The printing units 16Y, 16M, 16C and 16B have the same structure, except that the color of the toner used is different. Each of the printing units 16Y, 16M, 16C and 16B has a known structure for forming a latent image on a photoconductive body depending on an image which is to be printed, developing the latent image into a visible toner image, and transferring the toner image onto the recording paper.

The fixing unit 17 forms the first embodiment of the replaceable unit. The fixing unit 17 can be removed from the color printer i by opening the cover 18 of the color printer 1 and pulling handles 19 in the direction of the arrows in FIG. 3. The fixing unit 17 can be placed into the color printer 1 by carrying out a reverse operation to that carried out when removing the fixing unit 17 from the color printer 1. In this embodiment, it is assumed for the sake of convenience that the fixing unit 17 includes a fixing section which carries out a thermal fixing by a known method, and the illustration and description of this fixing section will be omitted.

The main control circuit 23 includes a CPU 31 which is provided with an analog-to-digital (A/D) converter 30, a ROM 32, a RAM 33, a sensor input circuit 34, a reset circuit 35, a motor driving circuit 36, an EEPROM 37, a transistor 38 for supplying a relay driving current, and a voltage dividing resistor 39. The CPU 31 executes programs stored in the ROM 32, and controls various parts within the color printer 1. For example, the CPU 31 controls the transport of the recording paper by driving the motor 24 via the motor driving circuit 36, and controls the driving of each of the printing units 16Y, 16M, 16C and 16B. The RAM 33 stores various information necessary when executing the programs in the CPU 31. The sensor input circuit 34 inputs detection signals which are received from the sensors 21-1 through 21-n.

The EEPROM 37 stores serviceable life data of various replaceable units including the fixing unit 17. For example, the operation time of the fixing unit 17 or the number of prints made by the fixing unit 17 is counted by an internal counter of the CPU 31, and a counted value of this internal counter is stored in the EEPROM 37 as the serviceable life data. The reset circuit 35 is provided to reset the internal counter of the CPU 31. The A/D converter 30 within the CPU 31, the transistor 38 and the resistor 39 are respectively connected to the connecting section 41. The connecting section 42 is grounded. The connecting sections 43 and 44 are connected to the power supply circuit 25, and the power supply circuit 25 is connected to the power supply 22 via the CPU 31.

On the other hand, the fixing unit 17 includes a latching relay 51, a thermistor 52, and a heater 53 which forms a portion of the fixing section. The relay 51 is made up of a switch and a coil which are connected in series. The thermistor 52 is provided to detect a temperature within the fixing unit 17, that is, an operating state of the fixing unit 17. In a state where the fixing unit 17 is placed into the color printer 1, the relay 51 and the thermistor 52 are connected to the main control circuit 31 via the connecting sections 41 and 42, and the heater 53 is connected to the power supply circuit 25 via the connecting sections 43 and 44. The heater 53 generates heat in response to a current supplied from the power supply circuit 25, and the heater 53 is controlled by the CPU 31 via the power supply circuit 25. The connecting sections 41 through 44 may be formed by known connectors or the like.

Figure 4:
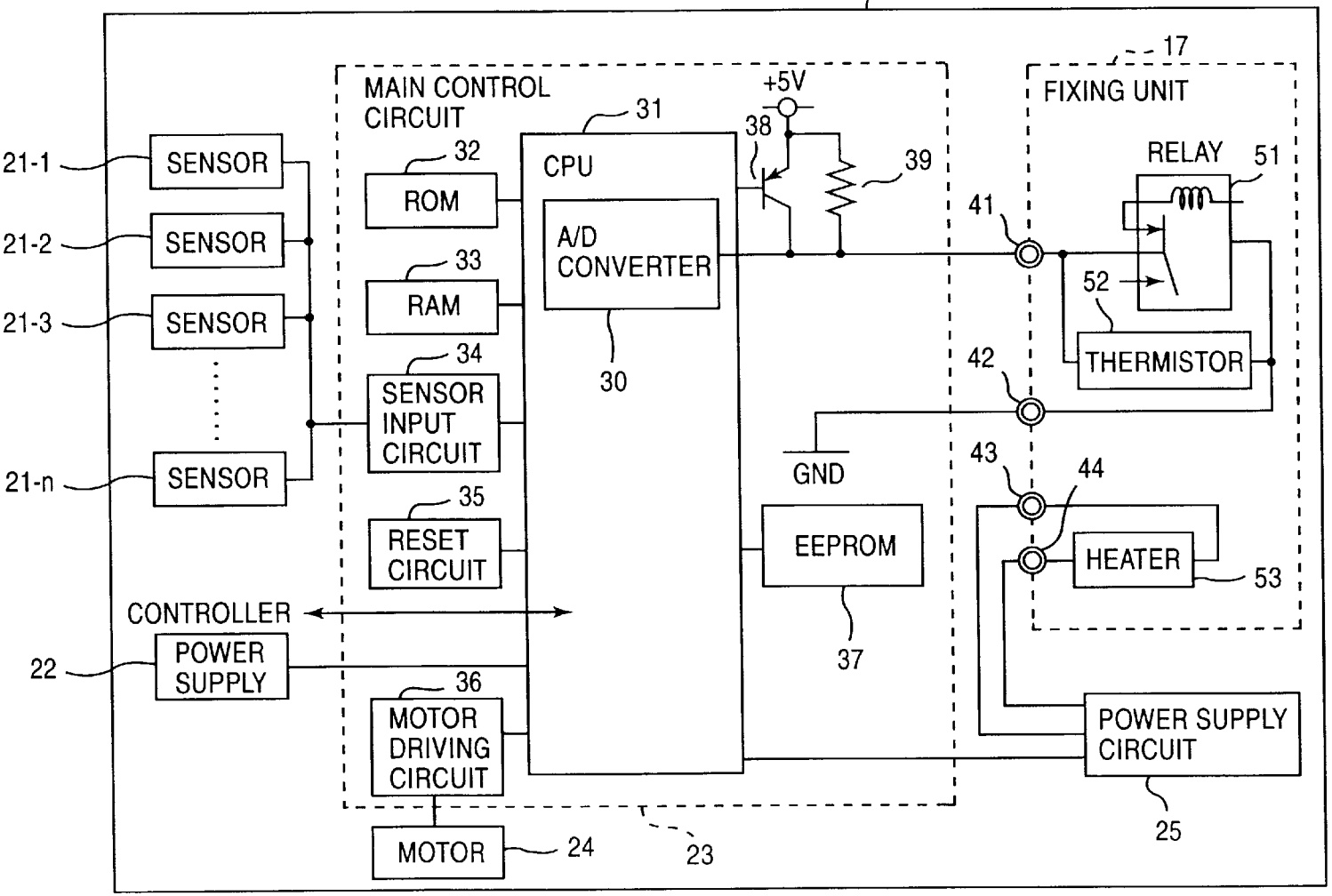
FIG. 4 is a system block diagram showing a control system of the first embodiment of the apparatus.

The relay 51 and the thermistor 52 are connected in parallel, and a node connecting the relay 51 and the thermistor 52 is connected to the connecting section 41. An output signal of the fixing unit 17 which is obtained from the connecting section 41 is detected by the A/D converter 30 which is provided within the CPU 31 of the main control circuit 23. The transistor 38 and the resistor 39 within the main control circuit 23 are connected as shown in FIG. 4. The relay 51 is provided to hold a new/used identification signal of the fixing unit 17. The transistor 38 is provided to receive a driving current of the relay 51, and the resistor 39 is provided to generate a temperature detection signal by a divided voltage of the resistor 39 and the thermistor 39.

Figure 5:
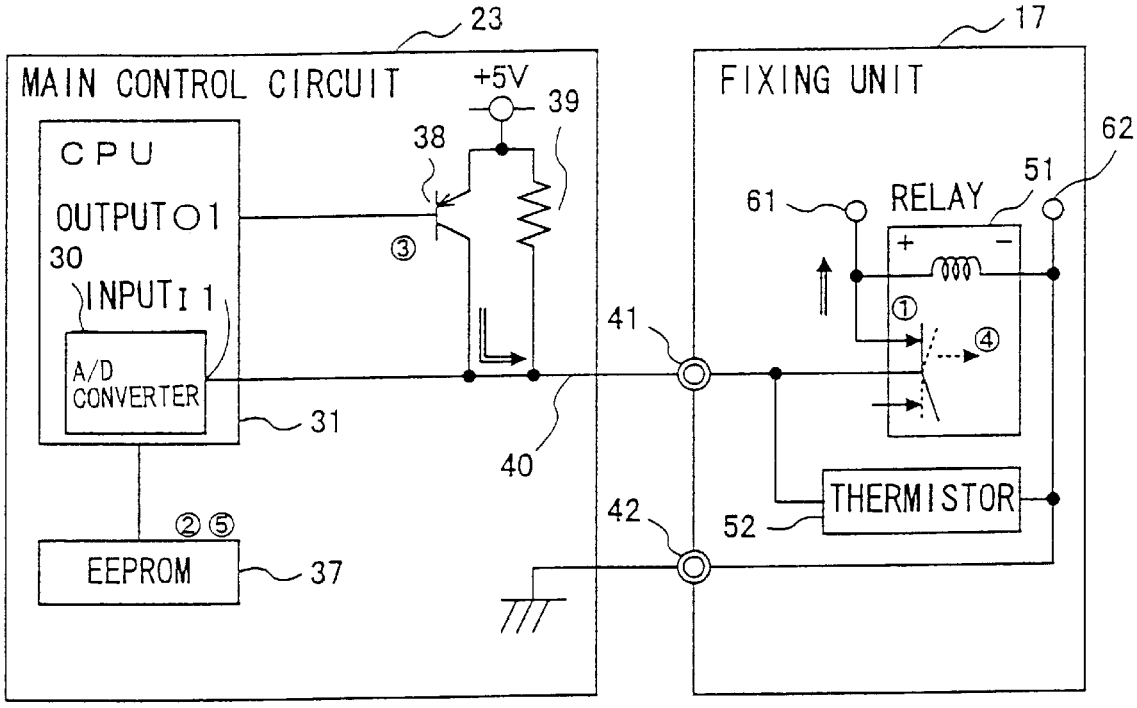
FIG. 5 is a diagram showing an important part of the control system shown in FIG. 4.

FIG. 5 is a diagram showing an important part of the control system shown in FIG. 4. In FIG. 5, the connecting section 41 is connected to the A/D converter 30 within the CPU 31 via a temperature detection signal line 40. The fixing unit 17 is provided with probing pads 61 and 62 which are used to apply a reverse bias voltage when returning the switch of the relay 51 to the closed state. In this embodiment, the new/used identification signal of the fixing unit 17 is held by the relay 51, and thus, the circuit can be driven by +5 V, and in addition, the single temperature detection signal line 40 can be used in common for transferring the temperature detection signal, the new/used identification signal and a used setting signal. For this reason, it is possible to suppress an increase of the number of terminals required in the connecting sections. Furthermore, by use of the relay 51, it becomes possible to return the setting of the fixing unit 17 which is once set to the used state back to the new state.

Next, a description will be given of an operation of this embodiment, according to steps ① through ⑤ indicated in FIG. 5.

Step ⓪: In a state where setting of the fixing unit 17 is the new state, the switch of the relay 51 is closed. Accordingly, the temperature detection signal line 40 is grounded via the coil of the relay 51 and the connecting section 42, and a voltage on the order of approximately 0.1 V is detected at an input I1 of the CPU 31, that is, in the A/D converter 30. When this voltage on the order of approximately 0.1 V is detected, the CPU 31 recognizes that the fixing unit 17 is new. In an operating temperature range of the fixing unit 17, the voltage of the output signal obtained from the fixing unit 17 will not become on the order of approximately 0.1 V.

Step ②: When the fixing unit 17 is recognized as being new, the CPU 31 clears the serviceable life data related to this fixing unit 17 within the EEPROM 37.

Step ③: After the serviceable life data related to the fixing unit 17 is cleared within the EEPROM 37, the CPU 31 controls the transistor 38 to an ON state by an output O1, and outputs a driving current for driving the relay 51 to the connecting section 41, in order to change the setting of the fixing unit 17 to the new state. In FIG. 5, this driving current is indicated by a double arrow.

Step ④: When the relay 51 is driven by the driving current from the transistor 38 and the switch of the relay 51 is opened, the temperature detection signal from the thermistor 52 is detected at the input I1 of the CPU 31. When the temperature detection signal is correctly detected at the CPU 31, the CPU 31 no longer recognizes the fixing unit 17 as being new and recognizes the fixing unit 17 as being used.

Step ⑤: After the CPU 31 recognizes the fixing unit 17 as being used, the internal counter of the CPU 31 counts the number of prints made by the color printer 1 or the operation time of the fixing unit 17, and the CPU 31 stores a counted value of the internal counter in the EEPROM 37 as the serviceable life data related to the fixing unit 17. When the counted value of the internal counter exceeds a predetermined value, the CPU 31 notifies the replacing timing of the fixing unit to the user by a known method and urges the user to replace the fixing unit 17. The replacing timing of the fixing unit 17 may be determined arbitrarily, and for example, may be determined based on at least one of the number of prints made and the operation time or the driving time of the fixing unit 17, with reference to a predetermined threshold value. In addition, the serviceable life of the fixing unit 17 may be determined arbitrarily based on specifications and the like of the color printer 1.

Figure 6:
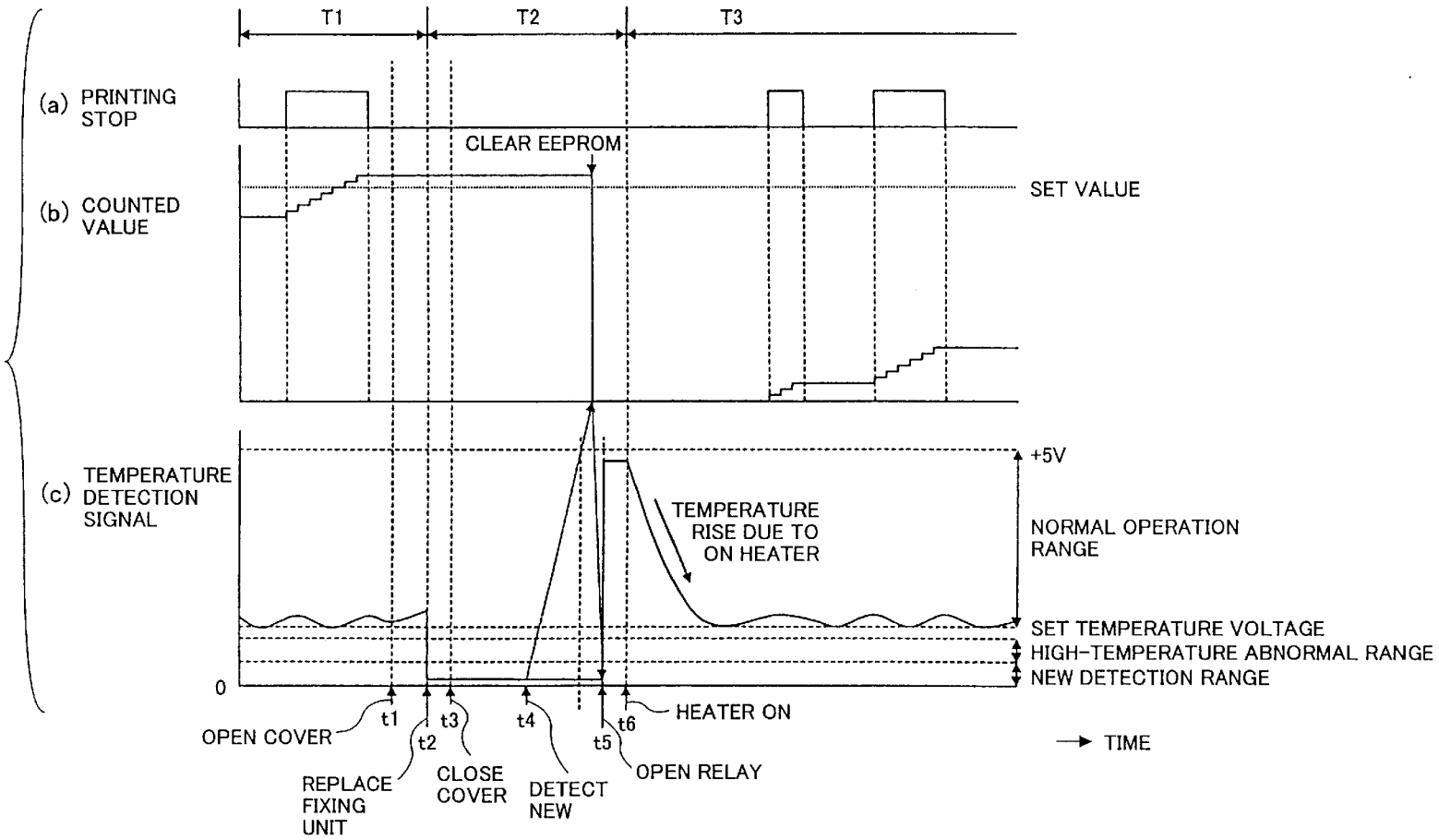
FIG. 6 is a timing chart for explaining an operation of the first embodiment of the apparatus.

FIG. 6 is a timing chart for explaining the operation of this embodiment. In FIG. 6, the abscissa indicates the time, (a) indicates a printing state of the color printer 1 by a high level and a printing stopped state of the color printer by a low level, (b) indicates a counted value of the internal counter of the CPU 31 related to the serviceable life of the fixing unit 17, and (c) indicates the temperature detection signal which is supplied to the CPU 31 via the temperature detection signal line 40.

The temperature detection signal is a wired-OR output of the thermistor 52 and the relay 51 shown in FIG. 5. The thermistor 52 detects the temperature within the fixing unit 17. Since the heater 53 is controlled so that the temperature of the fixing section (fixing roller) becomes a set temperature which is necessary to fix the toner images, the temperature detection signal will only decrease to a set temperature voltage and will change within a normal operation range. If for some reason the temperature of the fixing section becomes too high, the temperature detection signal will decrease to a high-temperature abnormal range. The CPU 31 generates an alarm and stops the operation of the color printer 1 when a value of the temperature detection signal within the high-temperature abnormal range is detected. When the fixing unit 17 is new, the temperature detection signal line 40 is grounded via the coil of the relay 51, and the temperature detection signal is output in a new detection range. In a case where the temperature detection signal is within the new detection range when the power of the color printer 1 is turned ON or the cover 18 of the color printer 1 is closed, the CPU 31 recognizes the fixing unit 17 as being new. In addition, when the temperature detection signal is within the new detection range during the normal operation of the color printer 1, the CPU 31 detects a high-temperature abnormality and stops the operation of the color printer. The open and closed states of the cover 18 is detected by at least an arbitrary one of the sensors 21-1 through 21-n, and the open or closed state of the cover 18 is notified to the CPU 31 via the sensor input circuit 34.

In FIG. 6, T1 indicates an operating time period of the used fixing unit 17, T2 indicates a time period of a new/used detecting operation which detects whether the fixing unit 17 is new or used when the cover 18 is closed, and T3 indicates an operating time period of the fixing unit 17 after the setting of the fixing unit 17 is set to the used state. In addition, tl indicates a time when the cover 18 is opened, t2 indicates a time when the fixing unit 17 is replaced, t3 indicates a time when the cover 18 is closed, t4 indicates a time when the new fixing unit 17 is detected, t5 indicates a time when the switch of the relay 51 is opened, and t6 indicates a time when the heater 53 of the fixing unit 17 is turned ON.

First, the operation during the operating time period T1 of the used fixing unit 17 is as follows. When the printing is made during the operation of the color printer 1, the serviceable life data related to the fixing unit 17, that is, the counted value of the internal counter is successively counted up in the CPU 31 and is stored in the EEPROM 37. In this state, the temperature of the fixing section of the fixing unit 17 is controlled to a set temperature, and the voltage of the signal from the thermistor 52 changes within the normal operation range. When the counted value of the internal counter reaches a set value or, a predetermined threshold value, due to the printing made in the color printer 1, a message or the like is displayed on a display panel (not shown) of the color printer 1 by a known means to notify the user that the serviceable life of the fixing unit 17 is ending, so as to make the user become aware that it is time to replace the fixing unit 17. When the user receives this notification regarding the ending serviceable life of the fixing unit 17, the user opens the cover 18 of the color printer 1 and replaces the fixing unit 17 by a new fixing unit 17.

Next, the operation during the time period T2 of the new/used detecting operation which detects whether the fixing unit 17 is new or used when the cover 18 is closed, is as follows. When the fixing unit 17 is replaced by the new fixing unit 17, the voltage of the temperature detection signal becomes approximately 0.1 V which is within the new detection range. After the cover 18 is closed, the CPU 31 carries out the new/used detecting operation before turning ON the heater 53 of the new fixing unit 17 as a normal starting process with respect to the new fixing unit 17. A description will now be given of the operation of the CPU 31 during this new/used detecting operation, by referring to FIG. 7.

Figure 7:
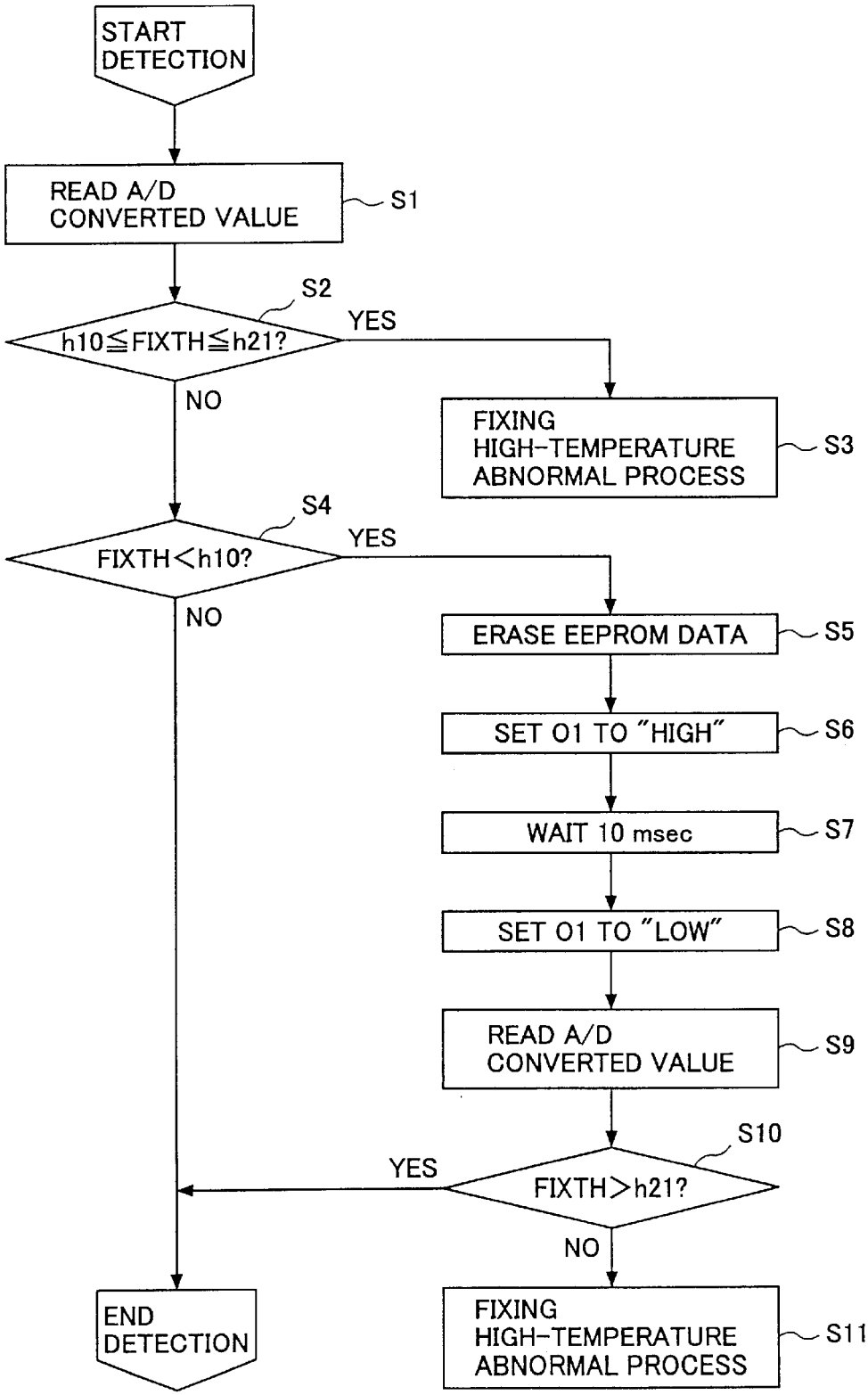
FIG. 7 is a flow chart for explaining an operation of a CPU during a new/used detecting operation.

FIG. 7 is a flow chart for explaining the operation of the CPU 31 during the new/used detecting operation. In FIG. 7, when the new/used detecting operation is started, a step S1 reads the temperature detection signal which is input via the A/D converter 30, and denotes the read A/D converted value by FIXTH. A step S2 decides whether or not the temperature detection signal is within the high-temperature abnormal range. More particularly, the step S2 decides whether or not the A/D converted value FIXTH is greater than or equal to an A/D converted value h10 but is less than or equal to an A/D converted value h21. For example, the A/D converted value h10 corresponds to 0.3 V, and the A/D converted value h21 corresponds to 0.65 V. If the decision result in the step S2 is YES, a step S3 carries out a fixing high-temperature abnormal process, and stops the operation of the color printer 1 by generating an alarm.

On the other hand, if the decision result in the step S2 is NO, a step S4 decides whether or not the temperature detection signal is within the new detection range. More particularly, the step S4 decides whether or not the A/D converted value FIXTH is less than the A/D converted value h10. The process ends if the decision result in the step S4 is NO. Alternatively, the step S4 may decide whether or not the A/D converted value FIXTH is greater than or equal to an A/D converted value h00 but is less than the A/D converted value h10, where the A/D converted value hOO corresponds to 0 V in this case.

If the decision result in the step S4 is YES, the CPU 31 recognizes that the fixing unit 17 is new, and the process advances to a step S5. The step S5 clears the counted value of the internal counter, which is related to the serviceable life of the fixing unit 17 and is stored in the EEPROM 37. In addition, a step S6 controls the driving signal which is obtained from the output O1 of the CPU 31 to a low level. In other words, by outputting the driving current from the output O1, the transistor 38 is turned ON, and the relay 51 is driven to open the switch of the relay 51. When the switch of the relay 51 is opened, the temperature detection signal becomes the output of the thermistor 52. A step S7 waits for a driving time of the relay 51, which is 10 msec, for example. Thereafter, a step S8 controls the driving signal which is obtained from the output O1 of the CPU 31 to a high level. In other words, by not outputting the driving current from the output O1, the transistor 38 is turned OFF. A step S9 again reads the temperature detection signal which is input via the A/D converter 30, and a step S10 decides whether or not a normal temperature detection signal is output. More particularly, the step S10 decides whether or not the A/D converted value FIXTH is greater than the A/D converted value h21. The process ends if the decision result in the step S10 is YES. On the other hand, if the decision result in the step S10 is NO, the temperature detection signal is within the high-temperature abnormal range even after the setting of the fixing unit 17 is set to the used state, and thus, a step Sil carries out a fixing high-temperature abnormal process similar to that of the step S3 described above.

By carrying out the new/used detecting operation in the above described manner, it is possible to detect whether the fixing unit 17 is new or used. In addition, when the fixing unit 17 is detected as being new, the counted value of the internal counter, which is related to the serviceable life of the fixing unit 17 and is stored in the EEPROM 37, is cleared.

The operation during the operating time period T3 of the fixing unit 17 after the setting of the fixing unit 17 is set to the used state, is as follows. In this case, the normal starting process with respect to the fixing unit 17 turns the heater 53 ON and raises the temperature of the fixing section to a set temperature. Thereafter, when the temperature of the fixing section reaches the set temperature and the printing operation of the color printer 1 is carried out, the counted value of the internal counter which is related to the serviceable life of the fixing unit 17, is successively counted up from zero.

Figure 8:
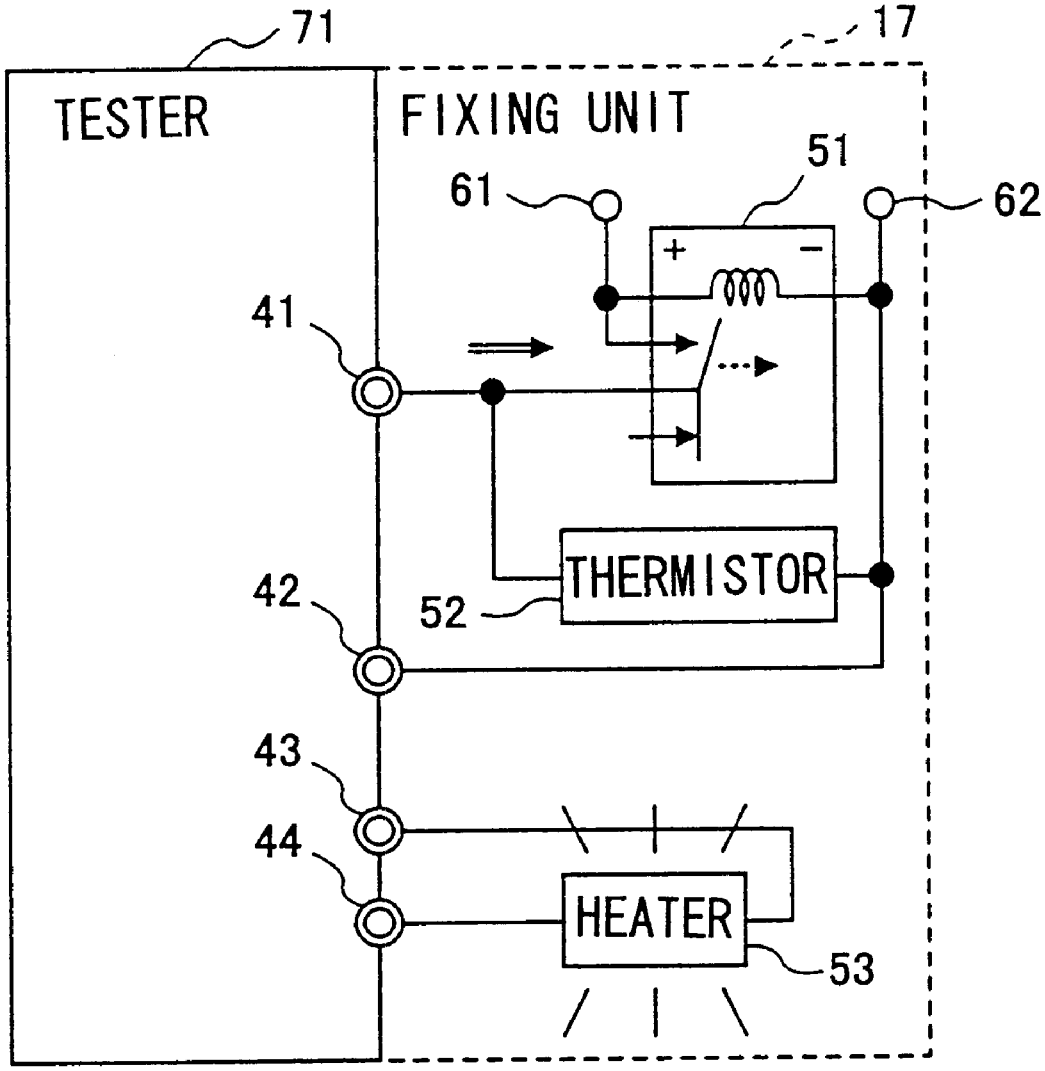
FIG. 8 is a diagram for explaining a test carried out when forwarding the fixing unit.
Figure 9:
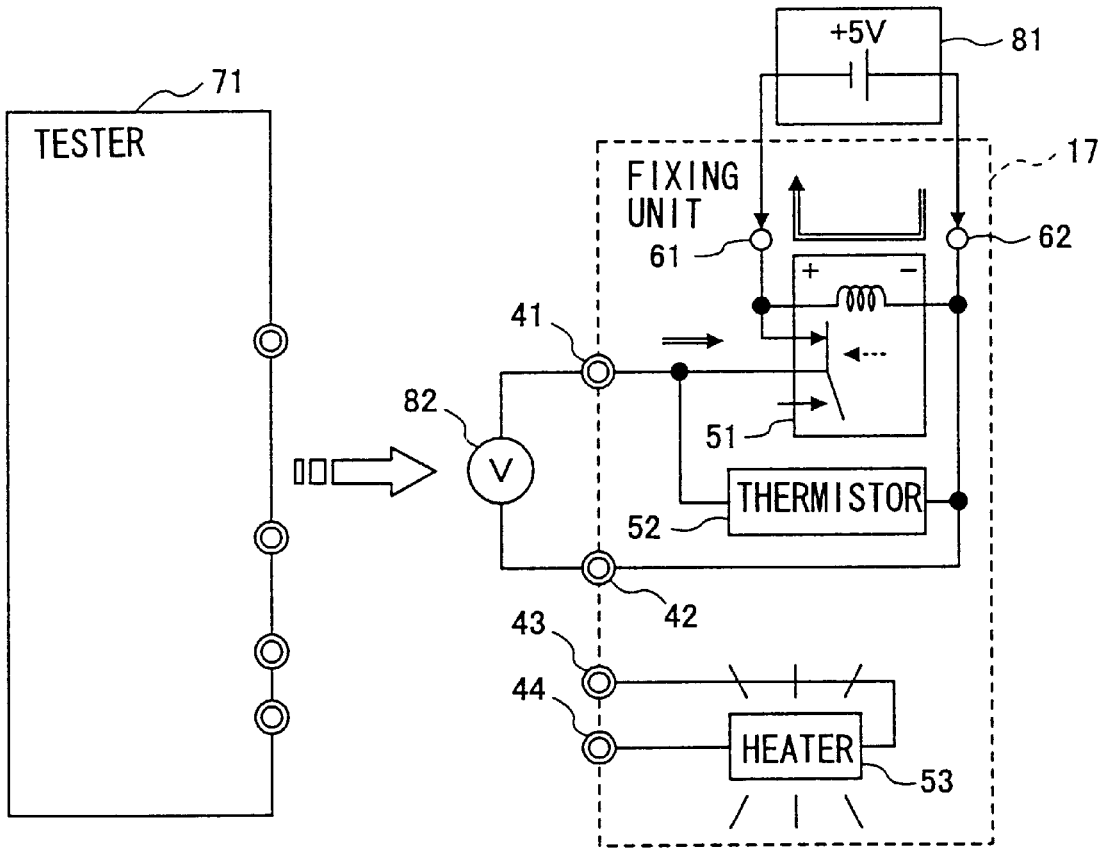
FIG. 9 is a diagram for explaining a resetting of the tested fixing unit as a new fixing unit after the test.

Next, a description will be given of a test (or inspection) which is carried out when forwarding the fixing unit 17, and the resetting of the tested fixing unit 17 as a new fixing unit after the test. FIG. 8 is a diagram for explaining a test carried out when forwarding the fixing unit 17. Further, FIG. 9 is a diagram for explaining a resetting of the tested fixing unit 17 as a new fixing unit 17 after the test. In FIGS. 8 and 9, those parts which are the same as those corresponding parts in FIGS. 4 and 5 are designated by the same reference numerals, and a description thereof will be omitted.

When testing the fixing unit 17 before forwarding the fixing unit 17, the fixing unit 17 is connected to a tester 71 as shown in FIG. 8. The tester 71 sets the setting of the fixing unit 17 to the used state, and carries out a temperature detection by the thermistor 52 by turning the heater 53 ON, similarly to the above described case where the color printer 1 is started, so as to test the new/used detecting function of the fixing unit 17. By carrying out this test, the switch of the relay 51 becomes open.

After the test of the fixing unit 17 ends, the setting of the tested fixing unit 17 is reset to the new state in the following manner, because the tested fixing unit 17 is actually new. First, the tested fixing unit 17 is disconnected from the tester 71 as shown in FIG. 9, and a reverse bias voltage is applied across the probing pads 61 and 62 which are provided on both ends of the relay 51. For example, the reverse bias voltage is +5 V, and this reverse bias voltage may be applied by a reverse bias applying tool 81. By applying the reverse bias voltage across the probing pads 61 and 62, the switch of the relay 51 is returned to he closed state. In this state, it is possible to confirm that the switch of the relay 51 is returned to the closed state, by monitoring the voltage across both ends of the thermistor 62 via the connecting sections 41 and 42 by use of a monitoring apparatus 82 such as a voltmeter.

The reverse bias applying tool 81 and the monitoring apparatus 82 may be built into the tester 71. In this case, the setting of the tested fixing unit 17 can be reset to the new state in the state connected to the tester 71 as indicated by an arrow in FIG. 9, without having to remove the tested fixing unit 17 from the tester 71.

Next, a description will be given of a second embodiment of the apparatus having the replaceable unit according to the present invention. This second embodiment of the apparatus employs a second embodiment of the replaceable unit according to the present invention. In addition, in this second embodiment, the present invention is applied to the image forming apparatus having the replaceable fixing unit, similarly as in the case of the first embodiment described above.

Figure 10:
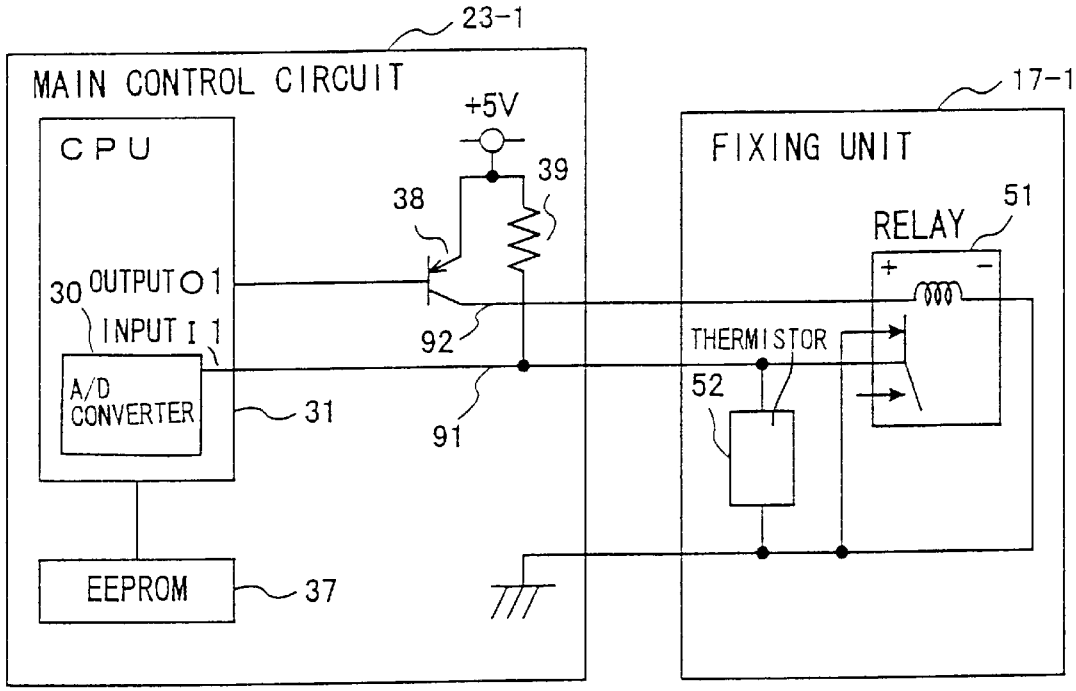
FIG. 10 is a diagram showing an important part of a control system of a second embodiment of the apparatus according to the present invention.

FIG. 10 is a diagram showing an important part of a control system of this second embodiment of the apparatus according to the present invention. In FIG. 10, those parts which are the same as those corresponding parts in FIG. 5 are designated by the same reference numerals, and a description thereof will be omitted. In addition, those parts of the apparatus not shown in FIG. 10 are the same as those corresponding parts of the first embodiment described above, and an illustration and description thereof will be omitted.

In this second embodiment, the relay 51 and the thermistor 52 within a fixing unit 17-1 are connected as shown in FIG. 10. In addition, the transistor 38 and the resistor 39 within a main control circuit 23-1 are connected as shown in FIG. 10. For the sake of convenience, the illustration of the connecting sections is omitted in FIG. 10.

In the first embodiment described above, the single temperature detection signal line 40 is used in common for transferring the temperature detection signal, the new/used identification signal and the used setting signal. On the other hand, in this second embodiment, one signal line 91 is used in common for transferring the temperature detection signal and the new/used identification signal, and one signal line 92 is used for the used setting signal.

Next, a description will be given of a third embodiment of the apparatus having the replaceable unit according to the present invention. This third embodiment of the apparatus employs a third embodiment of the replaceable unit according to the present invention. In addition, in this third embodiment, the present invention is applied to the image forming apparatus having the replaceable fixing unit, similarly as in the case of the first embodiment described above.

Figure 11:
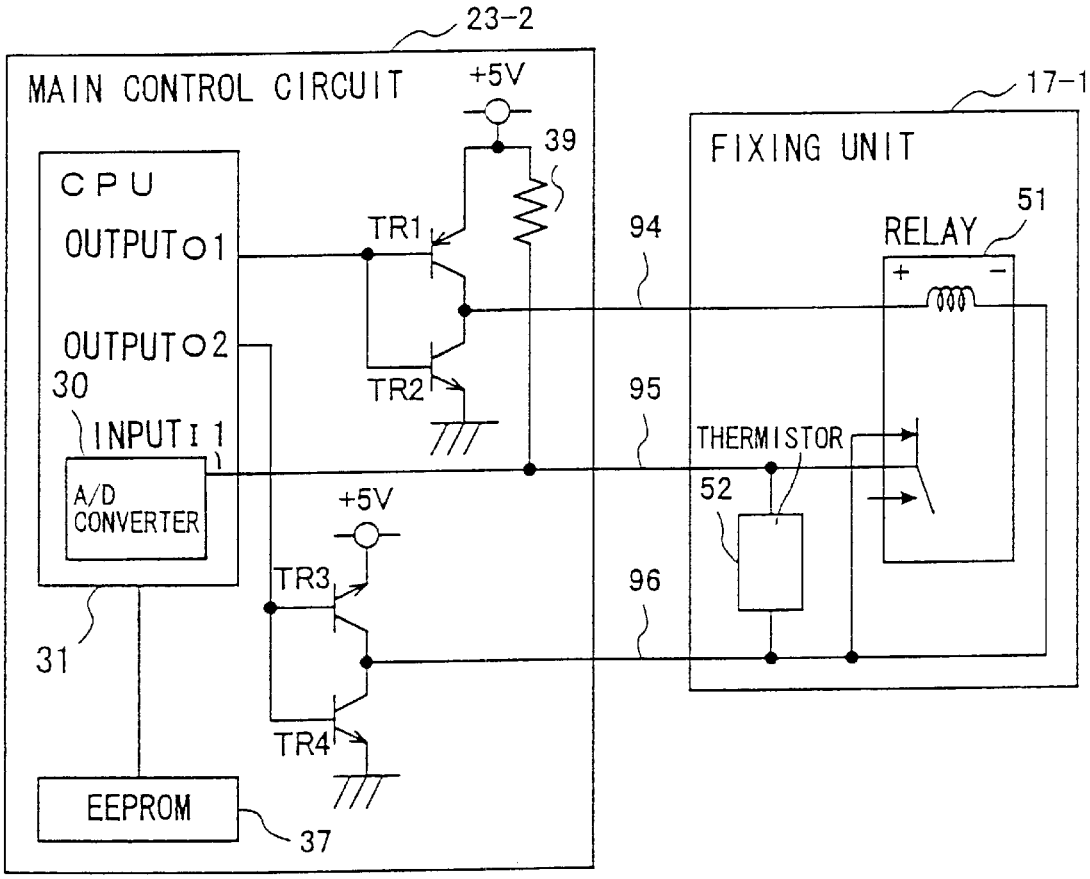
FIG. 11 is a diagram showing an important part of a control system of a third embodiment of the apparatus according to the present invention.

FIG. 11 is a diagram showing an important part of a control system of this third embodiment of the apparatus according to the present invention. In FIG. 11, those parts which are the same as those corresponding parts in FIG. 10 are designated by the same reference numerals, and a description thereof will be omitted. In addition, those parts of the apparatus not shown in FIG. 11 are the same as those corresponding parts of the first embodiment described above, and an illustration and description thereof will be omitted.

In this third embodiment, a main control circuit 23-2 has a construction capable of resetting the setting of the fixing unit 17-1 to the new state. In other words, the main control circuit 23-2 can also function as a tester. Transistors TR1 through TR4 which are connected as shown in FIG. 11 are provided within the main control circuit 23-2. The main control circuit 23-2 and the fixing unit 17-1 are connected by signal lines 94 through 96 via the connecting sections the illustration of which is omitted in FIG. 11. In addition, the CPU 31 includes an output O2 in addition to the input I1 and the output O1.

When the power of the color printer is turned ON, the normal operation is carried out to detect the new state of the fixing unit 17-1. In this state, the CPU 31 controls both the outputs O1 and O2 to the high level, and consequently, the transistors TRl and TR3 are turned OFF and the transistors TR2 and TR4 are turned ON. Accordingly, the signal line 96 is grounded via the transistor TR4, and the CPU 31 detects that the fixing unit 17-1 is new based on the new/used identification signal which is obtained at the input I1 from the signal line 95.

When the fixing unit 17-1 is detected as being new, the CPU 31 controls the output O1 to the low level, and controls the output O2 to the high level. As a result, the transistors TR2 and TR3 are turned OFF and the transistors TR1 and TR4 are turned ON. The signal lines 94 and 96 are connected via the transistors TR1 and TR4, and the switch of the relay 51 is opened.

When resetting the setting of the fixing unit 17-1 to the new state, the CPU 31 controls the output O1 to the high level, and controls the output O2 to the low level. Hence, the transistors TR1 and TR4 are turned OFF, and the transistors TR2 and TR3 are turned ON. The signal lines 96 and 94 are connected via the transistors TR2 and TR3, the switch of the relay 51 is closed, and the operation of the color printer returns to the normal operation.

The fixing unit is provided with the relay, the thermistor, the fixing section and the like, but the serviceable life depends on each part. The parts having a relatively short serviceable life are mainly mechanical parts. In each of the embodiments described above, the setting of the fixing unit which is once set to the used state can be reset to the new state. Hence, when the serviceable life of a part of the fixing unit ends, only this part can be replaced and the fixing unit may be used again as a new fixing unit, thereby considerably improving the parts utilization efficiency. Therefore, of the various parts provided on a circuit board of the fixing unit, for example, only the rollers, gears or the like with the expired serviceable lives need to be replaced by new parts, and other electronic parts or the like may continue to be used. As a result, it is possible to reduce the cost of the fixing unit and the running cost of the printer.

In each of the embodiments described above, the fixing unit is described as the replaceable unit. However, the replaceable unit is not limited to the fixing unit, and the present invention is of course similarly applicable to arbitrary replaceable units including printing units. Moreover, the apparatus having the replaceable unit is not limited to the image forming apparatus such as the printer, copying machine and facsimile machine, and the present invention is similarly applicable to any kind of apparatus having a replaceable unit.

Further, the present invention is not limited to these embodiments, but various variations and modifications may be made without departing from the scope of the present invention.

What is claimed is:

1. A replaceable unit to be placed in an apparatus, comprising:

a relay, including a latching type switch, outputting a new/used identification signal which indicates whether the replaceable unit is new or used depending on open and closed states of the switch;

a detecting part detecting an operating state within the replaceable unit and outputting a state detection signal indicating the operating state; and a single signal line which is used in common for transferring the new/used identification signal and the state detection signal.

2. The replaceable unit as claimed in claim 1, wherein said relay switches the switch to an open or closed state to output a new/used identification signal which indicates that the replaceable unit is used, in response to a used setting signal which sets the replaceable unit as being used.

3. The replaceable unit as claimed in claim 2, wherein said single signal line is further used in common for transferring the used setting signal.

4. The replaceable unit as claimed in claim 1, wherein:

said relay further includes a coil which is coupled in series to the switch;

said detecting part is coupled in parallel to said relay; and said single signal line is coupled to a node which connects said relay and said detecting part.

5. The replaceable unit as claimed in claim 1, further comprising:

terminals, coupled to said relay, receiving a bias voltage for switching the switch to an open or closed state.

6. The replaceable unit as claimed in claim 1, wherein:

said detecting part includes an element which detects a temperature; and said replaceable unit forms a fixing unit.

7. An apparatus having a replaceable unit, comprising:

a single signal line inputting a new/used identification signal which indicates whether the replaceable unit is new or used, and a state detection signal which indicates an operating state within the replaceable unit; and a controller detecting whether the replaceable unit is new or used based on the new/used identification signal which is input via said single signal line, and detecting the operating state within the replaceable unit based on the state detection signal.

8. The apparatus as claimed in claim 7, wherein:

said controller outputs a used setting signal which sets the replaceable unit as being used; and said single signal line is used in common for outputting the used setting signal to the replaceable unit.

* * * * *